United States Patent [19]

Tolson et al.

[11] Patent Number: 4,856,704

[45] Date of Patent: Aug. 15, 1989

[54] MACHINE PACKAGING TRAY

[75] Inventors: Sidney S. Tolson, Scotland Neck, N.C.; Charles S. Brumberg, Richmond, Va.

[73] Assignee: Ossid Corporation, Scotland Neck, N.C.

[21] Appl. No.: 191,547

[22] Filed: May 9, 1988

[51] Int. Cl.[4] ..... B65O 1/34

[52] U.S. Cl. ..... 229/2.5 R; D9/425; 229/900; 426/129

[58] Field of Search ..... 229/2 5 aR, 900, DIG. 12; D9/424–429; 206/45.33; 426/124, 129; 217/26, 26.5

[56] References Cited

U.S. PATENT DOCUMENTS

| | | | |
|---|---|---|---|
| D. 267,395 | 12/1982 | Groenewold et al. | D9/425 |
| 1,637,100 | 7/1927 | Bothe | 229/2.5 R |
| 3,185,371 | 5/1965 | Reifers | 229/2.5 R |
| 3,489,270 | 1/1970 | Bixler et al. | 426/129 |
| 3,580,413 | 5/1971 | Quackenbush | 229/2.5 R |
| 3,700,096 | 12/1972 | Reifers | 229/2.5 R |
| 3,720,365 | 3/1973 | Unger | 229/2.5 R |
| 4,009,817 | 3/1977 | Marshall et al. | 229/2.5 R |
| 4,349,146 | 9/1982 | Holden | 229/2.5 R |

FOREIGN PATENT DOCUMENTS

| | | | |
|---|---|---|---|
| 895188 | 5/1962 | United Kingdom | 229/2.5 R |

*Primary Examiner*—Gary Elkins

*Attorney, Agent, or Firm*—Olive & Olive

[57] ABSTRACT

An improved packaging tray for an "In-Line" film wrapping machine incorporates reinforced side walls and friction-engaging planar side surfaces adapted to prevent slippage between the transport belts of the wrapping machine and thus avoid loss of tray/machine registration, miswrapped packages, machine damage and machine downtime.

13 Claims, 2 Drawing Sheets

MACHINE PACKAGING TRAY

BACKGROUND OF THE INVENTION

1. Field of the Invention

The present invention relates generally to a molded packaging tray used in packaging meat and poultry with a stretch film overwrap and particularly to such a tray adapted for use in an "In-Line" packaging machine.

2. Description of the Related Art.

Stretch-film wrapping machines are typically used to package meat and poultry by film wrapping the poultry on trays fed sequentially to the machine. The trays used in such operations are typically molded of a polystyrene foam material and assume a substantially rigid form with limited flexibility.

There are two types of stretch film wrapping machines used with polystyrene trays. One such machine is referred to as the Push-Through type machine and the other machine is referred to as an "In-Line" type machine and which represents a more recent development in the trade.

The Push-Through machine secures a precut rectangular piece of film over an aperture. A loaded tray is then pushed vertically upward through the aperture and into the secured film. Since the film is stationary in relation to the loaded tray moving through it, the film is stretched over the product and tray. This stretching action applies as a downward force vector on the outer edge or lip of the tray. Accordingly, for the Push-Through machine, the lip of the tray is designed, for example, as illustrated in FIG. 1 and is engineered primarily to counter this downward force vector. Other trays of somewhat different cross-section for use in the Push-Through machine and adapted to counter this downward force vector are also known. The lip is typically round and thin and typically does not permit flat side sealing.

By comparison, the "In-Line" machine forms a continuous tube around a queued assembly of loaded trays flowing in a substantially horizontal path into the machine. As the tube of film surrounds each tray, the film is stretched over the lip as on the Push-Through machine. The stretching action applies a downward force vector to the lip of the tray. However, unlike the Push-Through machine, the "In-Line" machine uses a different system for cutting and folding of the film tube to produce individual packages. During this process, it is necessary that the film wrapped tray be held firmly. To accomplish this, the package is sandwiched and slightly compressed between opposed/vertical surfaces of two parallel transport belts which move the tray in a generally horizontal path. The cutting of the "tube", folding of the ends and tucking of the remaining film are accomplished while the tray is sandwiched between the vertical surfaces of the transport belts. If sufficient squeeze pressure is not applied to a tray during the aforementioned operations, the tray will slip in the transport belt causing loss of tray/machine registration, miswrapped packages, machine damage and machine down time. Therefore, sufficient squeeze pressure must be applied to avoid tray slip in the transport belts. Representative examples of an "In-Line" machine include Weldotron models 2002 and 2004, manufactured by Omori of Tokyo, Japan.

Prior to the present invention, it has been the practice to use the Push-Through type trays in the "In-Line" machine. However, the conventional Push-Through machine tray has proven to be inadequate to prevent slip and when used on the "In-Line" stretch wrap machine tends to cause loss of tray/machine registration, breakage of trays by end wall and sidewall fracture, miswrapped packages, machine damage and machine down time. Because of the increasing use of "In-Line" machines for large volume packaging, the poultry industry has encountered a problem of considerable magnitude.

The primary object of the invention thus becomes that of providing an improved poultry tray suited to use in the "In-Line" machine without encountering the various described problems. Other objects will become apparent as the description proceeds.

SUMMARY OF THE INVENTION

An improved packaging tray according to the present invention is especially useful in an "In-Line" film wrapping machine. The tray side walls include inwardly angled, enlarged friction-engaging planar surfaces which are purposely designed to tilt toward a vertical plane when engaged by the vertical surfaces of the transport belts. As a consequence, the improved tray of the invention substantially increases the contact area in contact with the vertical transport belts during film wrapping on the "In-Line" wrapping machine and thereby prevents slippage. Further, the improved tray of the invention permits stacking for transport to the site of use and incorporates a structural design with increased rigidity and strength to withstand the required squeeze pressure imposed by the transport belts of the "In-Line" wrapping machine without fracture of the side walls or end walls of the tray.

DETAILED DESCRIPTION OF THE PREFERRED EMBODIMENT

Figure 1:
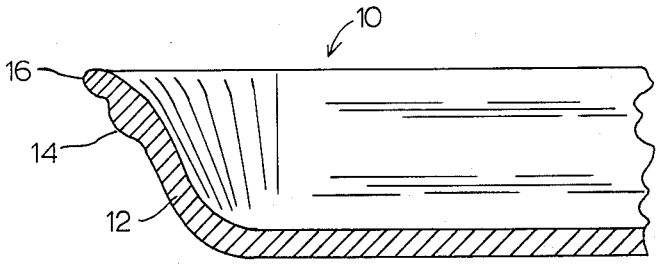
FIG. 1 (PRIOR ART)
FIG. 1 is a partial sectional view of the bottom and one side wall of a conventional prior art tray as used in a Push-Through type machine.

FIG. 1 illustrates a portion of a conventional prior art rigid packaging tray 10 of the Push Through machine type as presently used in the "In-Line" film wrapping machine. The side portion 12 and external rib portion 14 below lip edge 16 terminate in the external typically thin and rounded lip edge 16. Further, such a tray while suited to resisting a downward force is devoid of substantial, generally vertical, flat side surface areas suited to frictionally engage a conveyor belt of the type found in an "In-Line" type wrapping machine and also suited to flat surface side sealing. It is this type of conventional prior art tray that has been conventionally used with some success in the conventional Push-Through type film wrapping machine but without success in the "In-Line" type machine.

A first embodiment of an improved packaging tray 20 of the present invention is illustrated in FIGS. 2–6. Tray 20 incorporates a rectangular bottom wall 22 of substantially uniform thickness T, and upwardly and outwardly inclined side walls comprising end walls 24A and 24B and side walls 26A and 26B joined by a smooth transition.

Figure 3:
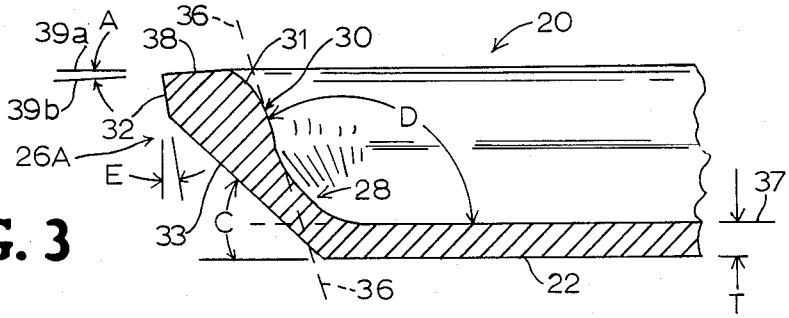
FIG. 3 is a partial sectional view of the bottom and one side wall of the tray of FIG. 2 illustrating the improved side wall construction of the invention.
Figure 4:
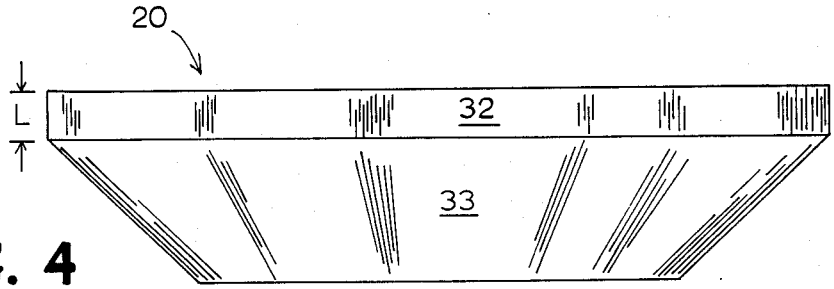
FIG. 4 is a side elevational view of the tray of FIG. 2.
Figure 2:
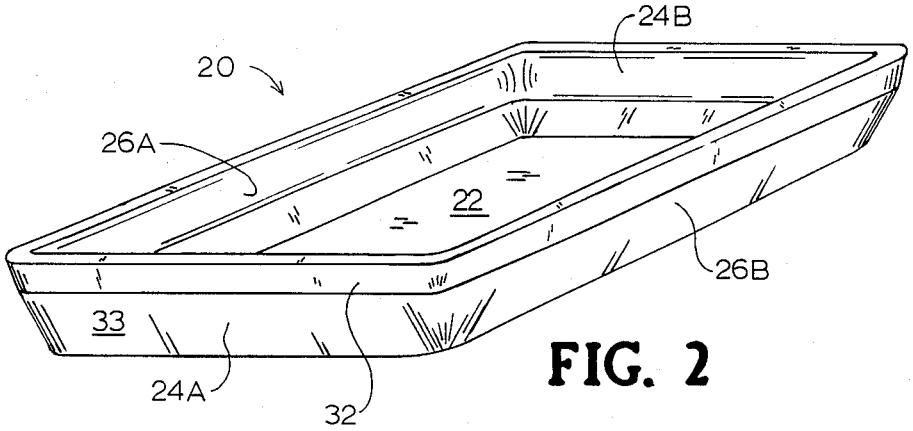
FIG. 2 is a perspective view of a first embodiment of an improved packaging tray according to the present invention.

As illustrated best in FIG. 3, each side wall 26A and 26B includes a lower portion 28 and an upper portion 30. Lower portion 28 has substantially the same thickness as bottom section 22. Upper portion 30 provides an internal reinforcing portion 31 having a thickness substantially greater than the lower portion 28. It is preferred that portion 31 have a convex surface as illustrated in FIG. 3.

The exterior outer surface of upper portion 30 includes a planar belt gripping surface 32. It is preferred that planar surface 32 have a width L preferably between about 0.187 inch and 0.500 inch. Furthermore, it is preferred that planar surface 32 be inclined from the vertical at an inwardly-oriented angle E ranging from 1° to 20°.

The exterior surface 33 of the lower portion 28 of each end wall 24A and 24B and side wall 26A and 26B is planar and form a flat film retaining surface 33 as an extension of flat exterior surface 32 though the surfaces may be joined by a narrow width outwardly curved exterior transistional surface. Retaining surface 33 is oriented at an exterior angle C preferably ranging from approximately 30° to 45°. The interior surface of each side wall 26A and 26B is oriented in reference to lines 36, 37 at an interior angle D ranging from approximately 90° to 125°. It is preferred that upper surface 38 of each side wall 26A and 26B be sloped downwardly to form angle A ranging between approximately 2° and 15° as referenced to lines **39*a*, 39*b***.

Figure 6:
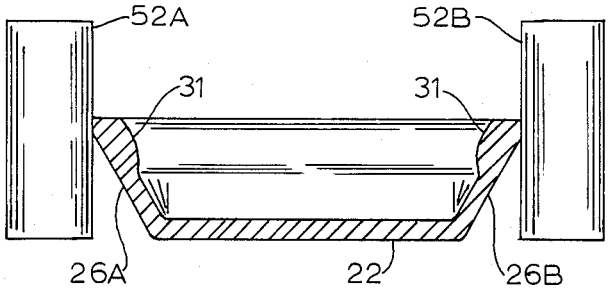
FIG. 6 is an end elevation view of FIG. 5 illustrating how the conveyor belts engage the invention tray.
Figure 5:
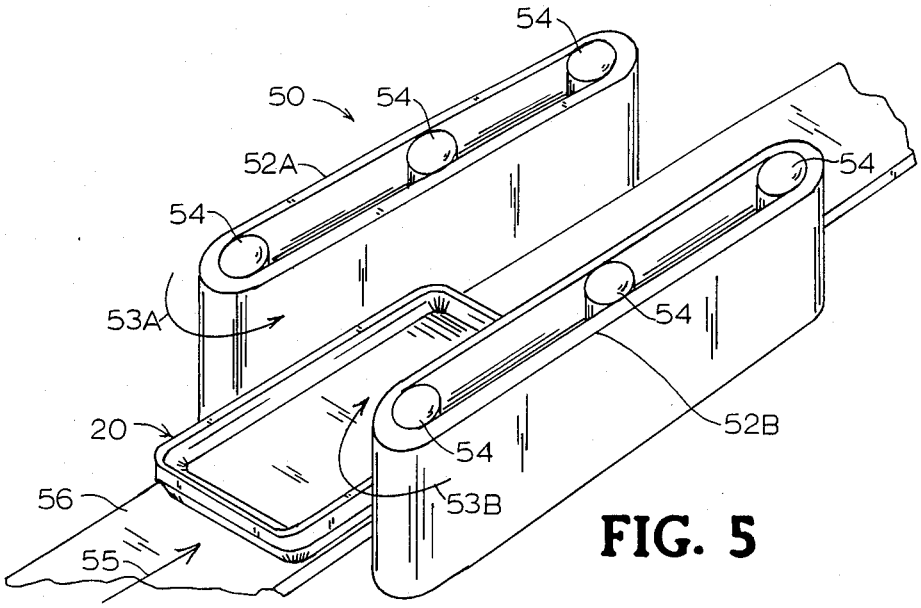
FIG. 5 is a schematic perspective view illustrating the tray of FIG. 2 being transported between opposed vertical surfaces of conveyor belts on an "In-Line" wrapping machine.

A schematic view of an "In-Line" wrapping apparatus 50 is illustrated in FIGS. 5 and 6. In use, tray 20 is fed by opposed transport belts 52A, 52B to a cutting, folding and tucking station (not shown) wherein stretch film is cut, folded and tucked to the tray 20 in a known manner. Belts 52A, 52B are rotated in the direction of arrows 53A and 53B, respectively, by drums 54. Belts 52A and 52B provide opposed vertical surfaces which contact the substantially vertical planar gripping surfaces 32 of side walls 26A and 26B and force a tray 20 to travel in the direction of arrow 55 on the support 56. The width of planar surfaces 32 provides adequate surface area to prevent slippage between tray 20 and belts 52A, 52B. As each tray 20 is drawn between belts 52A, 52B, side walls 26A and 26B are slightly squeezed toward one another and surfaces 32 are slightly tilted outwardly to ensure proper contact between surfaces 32 on side walls 26A and 26B and the interior vertical surfaces of belts 52A, 52B. Reinforcing portion 31 located within the tray and to a great extent substantially opposite the location of surface 32 provides the necessary strength in each side wall 26A and 26B to withstand the squeeze pressure of wrapping apparatus 50.

Once a tray 20 has been transported to the wrapping station, a film is stretched over the tray 20 in a conventional manner. The flat retaining surface 33 below surface 32 on the lower portion 28 of each respective side wall 26A, 26B provides a planar area to which the film adheres. Film may also be wrapped and heat sealed about the bottom surface of the bottom wall 22. The flat surfaces eliminate air pockets.

It is desirable that end walls 24A and 24B (FIG. 2) be constructed in a manner similar to side walls 26A and 26B. A similar inner reinforcing portion 31 for end walls 24A and 24B provides necessary strength to resist damage from the squeeze pressure of wrapping apparatus 50. The planar film retaining surface 33 for end walls 24A and 24B provides an end film-engaging surface for each tray 20 as it is fed through the wrapping apparatus 50. The planar surface 32 for end walls 24A and 24 is particularly useful for rectangular or square trays 20 and for film sealing without forming air pockets.

Figure 7:
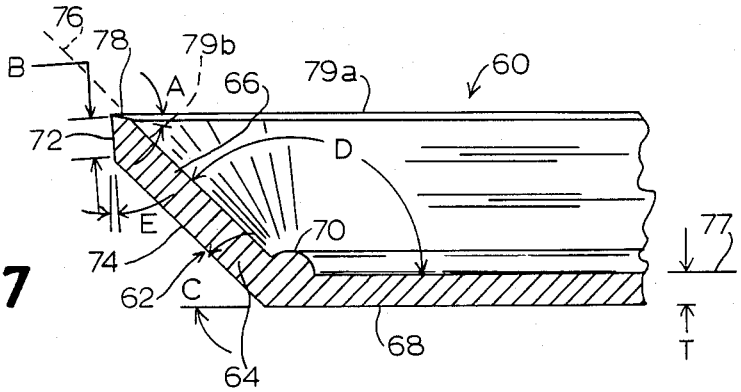
FIG. 7 is a partial sectional view of the bottom and one side wall of a second embodiment of an improved packaging tray according to the present invention.

A second embodiment of the improved packaging tray, indicated generally at 60, is illustrated in the sectional view of FIG. 7. Each side wall 62 of tray 60 includes a lower portion 64 and an upper portion 66. Lower and upper portions 64 and 66 have substantially the same thickness as the thickness T of the bottom section 68.

A reinforcing rib portion 70 is provided along the interior boundary between the side wall 62 and the bottom section 68 to provide the necessary strength to withstand the squeeze pressure of wrapping apparatus 50 as asserted by conveyor belts 52A, 52B. It is preferred that rib portion 70 also be provided between the end walls (not illustrated) and the bottom section 68.

It is preferred that rib portion 70 have a convex surface as illustrated in FIG. 7. In a most preferred embodiment, the radius of rib portion 70 ranges between 0.125 inch and 0.250 inch. It is also preferred in this embodiment that the interior surface of upper portion 66 be planar.

The exterior outer surface of upper portion 66 includes a friction-engaging planar surface 72. It is preferred that planar surface 72 have a width B of between 0.187 inch and 0.500 inch. Furthermore, it is preferred that planar surface 72 be inclined from the vertical at an inwardly-oriented angle E ranging from 1° to 20°.

The exterior surface 74 of side wall 62 is planar and forms a flat film retaining surface 74 as an extension of surface 72 for retaining film overwrapped on the package. Retaining surface 74 is oriented at an exterior angle C preferably ranging from approximately 35° to 70°. The interior surface of side wall 62 is oriented in reference to lines 76, 77 at an interior angle D preferably ranging from approximately 110° to 145°. It is preferred that upper surface 78 of side wall 62 be sloped downwardly to form angle A ranging between approximately 1° and 15° as referenced to lines **79*a*, 79*b***.

As with packaging tray 20, packaging tray 60 cooperates with the transport belts 52A and 52B of an "In-Line" wrapping apparatus 50. The inner vertical surfaces of belts 52A and 52B contact planar gripping surfaces 72 to prevent slippage of tray 60. Inner reinforcing rib portion 70 provides strength to withstand the squeeze pressure asserted by transport belts 52A and 52B of wrapping apparatus 50.

It will be noted that the design of tray 20 is such that a plurality of trays 20 are easily stackable. Likewise, the design of tray 60 provides easy stackability for a plurality of trays 60. Thus, maximum use of transportation space is provided when the trays are shipped to the site of use.

In use, the improved trays 20 and 60 of the present invention operate without slippage in the transport belts 52A, 52B thus avoiding loss of tray/machine registration, miswrapped packages, machine damage and machine down time as in the past. Further, the improved structural designs as illustrated in FIGS. 2–7 easily withstand the required squeeze pressure and thus minimize damage to the trays 20 and 60 themselves. Additionally, the contiguous external flat side surfaces 32, 33 and flat bottom surface of bottom wall 22 facilitate sealing of the first embodiment as do the contiguous flat, external side surfaces 72,74 and flat bottom surface of bottom wall 68 of the second embodiment.

Although the present invention has been described with reference to preferred embodiments, persons skilled in the art will recognize that changes may be made in form and detail without departing from the spirit and scope of the invention.

What is claimed is:

1. A molded tray for the packaging of a product such as poultry in conjunction with an overwrap film applied while the tray is transported through a packaging machine having a pair of conveyor belts with opposed vertical belt surfaces between which the tray is gripped and travels during packaging, comprising:

(a) a substantially flat bottom wall for supporting the product being packaged;

(b) upwardly and outwardly inclined side walls having and extending from upper ends to the bottom wall and joined by a smooth transitional inner surface to said bottom wall along an inner boundary and forming the sides and ends of said tray, said side walls each having an outer peripheral substantially vertical planar gripping surface to enable said tray to be engaged by the vertical surfaces pressing inwardly against said planar gripping surfaces on the sides of the tray in a manner wherein said tray tends not to slip relative to the conveyor belts while being transported thereby; and (c) a reinforcing rib portion at the inner boundary of said side and bottom walls formed to rigidify and strengthen said tray to prevent breakage thereof during gripping and transport by said belts and to permit the outer surface of said walls to be formed with planar surfaces for flat sealing of the film, said rib portion forming said smooth transitional inner surface.

2. A molded tray as claimed in claim 1 wherein said side walls are formed with outer upwardly and outwardly inclined substantially planar sealing surfaces located immediately below and forming an extension of said planar gripping surfaces enabling overwrap film to be wrapped flat on the outside of the packaged tray against both said gripping and sealing planar surfaces.

3. A molded tray as claimed in claim 1 wherein said planar gripping surfaces are inwardly angled to a degree which permits said planar gripping surfaces to assume a substantially vertical position when gripped by said vertical belt surfaces.

4. A molded tray as claimed in claim 1 wherein said reinforcing portion comprises an inner thickness portion of the upper end of each said side wall.

5. A molded tray as claimed in claim 1 wherein the width of said vertical planar gripping surface is at least 0.187 inch.

6. A molded tray as claimed in claim 3 wherein said planar gripping surface is initially formed so as to be inwardly angled at an angle within the range of 1° to 20°.

7. A molded tray as claimed in claim 1 wherein said side walls are joined to said bottom wall at an interior angle D in the range of substantially 90° to 125° and said planar gripping surface has a width within the range of substantially 0.187 inch to 0.500 inch.

8. A molded tray for the packaging of a product such as poultry in conjunction with an overwrap film applied while the tray is transported through a packaging machine having a pair of conveyor belts with opposed vertical belt surfaces between which the tray is gripped and travels during packaging, comprising:

(a) a substantially flat bottom wall for supporting the product being packaged;

(b) upwardly and outwardly inclined side walls having and extending from upper ends to the bottom wall and joined by a smooth transitional inner surface to said bottom wall along an inner boundary and forming the sides and ends of said tray, said side walls each having an outer peripheral substantially vertical planar gripping surface proximate the upper end thereof providing sufficient planar gripping surface to enable said tray to be engaged by the vertical belt surfaces pressing inwardly against said planar gripping surfaces on the sides of the tray in a manner wherein said tray tends not to slip relative to the conveyor belts while being transported thereby;

(c) a smooth, non-planar, reinforcing portion along an inner surface of said walls formed with increased thickness to rigidify and strengthen said tray to prevent breakage thereof during gripping and transport by said belts; and (d) said side walls being formed with outer upwardly and outwardly inclined substantially planar sealing surfaces located immediately below and forming an extension of said planar gripping surfaces enabling overwrap film to be wrapped flat on the outside of the packaged tray against both said gripping and sealing planar surfaces.

9. A molded tray as claimed in claim 8 wherein said planar gripping surfaces are inwardly angled to a degree which permits said planar gripping surfaces to assume a substantially vertical position when gripped by said vertical belt surfaces.

10. A molded tray as claimed in claim 8 wherein said reinforcing portion comprises an inner thickness portion of the upper end of each said side wall.

11. A molded tray as claimed in claim 8 wherein the width of said vertical planar gripping surface is at least 0.187 inch.

12. A molded tray as claimed in claim 8 wherein said side walls are joined to said bottom wall at an interior angle D in the range of substantially 90° to 125° and said planar gripping surface has a width within the range of substantially 0.187 inch to 0.500 inch.

13. A molded tray as claimed in claim 9 wherein said planar gripping surface is initially formed so as to be inwardly angled at an angle within the range of 1° to 20°.

* * * * *